US006514275B2

(12) United States Patent
Röhrig

(10) Patent No.: US 6,514,275 B2
(45) Date of Patent: Feb. 4, 2003

(54) PACIFIER

(75) Inventor: Peter Röhrig, Vienna (AT)

(73) Assignee: Bamed AG, Altenhofen (CH)

( * ) Notice: Subject to any disclaimer, the term of this patent is extended or adjusted under 35 U.S.C. 154(b) by 122 days.

(21) Appl. No.: 09/725,782

(22) Filed: Nov. 29, 2000

(65) Prior Publication Data

US 2001/0012952 A1 Aug. 9, 2001

(51) Int. Cl.[7] ..... A61J 17/00
(52) U.S. Cl. ..... 606/234; 606/236
(58) Field of Search ..... 606/234, 235, 606/236; D24/194, 195, 196, 197, 198; 601/46, 67, 80, 139–142

(56) References Cited

U.S. PATENT DOCUMENTS

| | | | | |
|---|---|---|---|---|
| 3,964,489 A | * | 6/1976 | Kesselring | |
| 4,195,638 A | | 4/1980 | Duckstein | |
| 5,403,349 A | * | 4/1995 | Rohrig | 606/236 |
| D391,641 S | * | 3/1998 | Fields et al. | D2/194 |
| D393,074 S | * | 3/1998 | Fields et al. | D2/194 |
| 5,759,195 A | * | 6/1998 | Fields et al. | 606/236 |
| 5,772,684 A | * | 6/1998 | Shrock | 606/236 |

FOREIGN PATENT DOCUMENTS

| | | |
|---|---|---|
| AT | 379508 | 6/1985 |
| DE | 2837438 | 8/1978 |
| DE | 3117348 | 6/1981 |
| DE | 3316824 | 5/1983 |

* cited by examiner

*Primary Examiner*—Gloria M. Hale
(74) *Attorney, Agent, or Firm*—Ladas & Parry

(57) ABSTRACT

A pacifier includes a generally lemniscate-shaped shield provided with retractions on its two longer sides in the middle thereof, and a nipple fastened in a central opening of the shield. The shield, on each of both sides of the central shield opening, includes but one lateral opening that reaches as far as to the edge of the shield while leaving a frame part.

13 Claims, 1 Drawing Sheet

PACIFIER

FIELD OF THE INVENTION

The invention relates to a pacifier including a generally lemniscate-shaped shield provided with retractions on its two longer sides in the middle thereof, and a nipple fastened in a central opening of the shield.

From AT 379 508 B, a pacifier including a grid-shaped shield is known, wherein the grid holes constitute air-drying openings and are mutually separated by at least two central lip covering webs provided on both sides of the central opening and extending in the direction of the longer transverse axis of the nipple. Such a shield configuration entails the risk that the fingers of the infant are inserted in the openings of the shield and cannot be pulled out any more, being squeezed in the shield. Furthermore, the shield openings are insufficiently large so as to enable simple seizure by an adult.

In addition, pacifiers including a round or approximately lemniscate to oval-shaped pacifier shield are known, for instance, from DE 31 17 348 A, where the shield has several small holes distributed in the two shield sections on both sides of the nipple so as to impart a sieve-like aspect on the pacifier shield. Those holes, however, will frequently not suffice to guarantee sufficiently strong aeration and drying of the mouth region as well as saliva drainage.

U.S. Pat. No. 4,195,638 A as well as GB 112200 A describe pacifiers each including a shield having emergency respiration holes in the form of four small circular openings. Even those known pacifiers do not ensure sufficient aeration and saliva drainage in the mouth region.

DE 28 47 438 A discloses a pacifier including a shield that comprises several slit-shaped, curved openings provided around the central nipple opening and separated from one another by radial webs, which openings, on the one hand, cause an easier deformation of the shield and, on the other hand, are to function in the manner of a saliva collecting and draining channel. The overall surface of the openings is, however, relatively small as compared to the shield surface such that it cannot be safeguarded that the mouth region of the infant will be kept dry.

DE 33 16 824 A relates to a pacifier including a shield which likewise has four openings that are separated from one another by radial webs. Again, there is the risk of a finger of the infant being squeezed in the shield openings.

SUMMARY OF THE INVENTION

It is an object of the invention to provide a pacifier which, when in use, ensures sufficient aeration of the mouth region and the drainage and drying of saliva possibly present in this region in order to avoid irritations, reddening or inflammations of the sensitive skin of the infant in that region; in addition, material savings should be feasible and existing regulations relating to the formation of shield openings for providing emergency respiration openings should be taken into account in order to eliminate the risk of squeezing of a finger of the infant; moreover, the pacifier should be readily seizable by an adult.

In the pacifier according to the invention, the shield, on each of both sides of the central shield opening, comprises but one lateral opening that reaches as far as to the shield edge while leaving a frame part. By providing but one lateral opening in the shield, on each side of the central opening of the shield, which opening reaches as far as to the shield edge such that only a relatively small frame part defines the edge of the shield, it will be ensured that the lateral openings are large-surface openings allowing for sufficient aeration and saliva drying. When using the pacifier, saliva can thus be drained and dried such that the sensitive skin in the region of the mouth of the infant will remain dry even during an extended use of the pacifier and no irritations, reddening or inflammations will occur.

Since one respective lateral opening is provided on each of both sides of the central shield opening, the shield may be grasped in an extremely simple manner with the insertion of a finger into one of the large lateral openings being feasible. Since only one lateral opening is each provided per shield side and only a frame part of the shield is left, it is ensured that the lateral openings are sufficiently large to prevent the child's fingers from being squeezed in part of the pacifier shield. In case the pacifier is swallowed by an infant, the large lateral openings are also perfectly apt as emergency respiration openings allowing for continued breathing.

Since but one lateral opening is each provided on the shield sides, no webs or, more general, material regions are present between the lateral openings as in the known pacifiers, thus simplifying the manufacture of the pacifier. Also may the mass of the shield material be reduced to a minimum, thus likewise enabling simple and cost-effective production.

For reasons of symmetry, the central retractions of the shield may be designed to be equal on the two longer sides so as to avoid different upper and lower sides of the pacifier. Preferably, at least one retraction is designed in such a manner that sufficient nose freedom will be ensured in the nose region of the infant.

The shapes of the lateral openings may be realized in various ways, sharp edges and pointed corners being preferably avoided in order to minimize the risk of injury.

Since, furthermore, the shield is not provided with a number of openings mutually separated by webs, the pacifier according to the invention does not cause individual tissue parts to protrude through relatively small apertures or parts (the webs) of the shield to be impressed or pinched in the mouth region of the child, even during intensive suction.

Preferably, the shield frame parts, on the two shorter sides, each comprise an indentation located, in particular, in the region of the longitudinal axis of the shield. Such indentations provide for an elevated dimensional stability of the pacifier shield such that the frame parts exhibit an increased resistance to bending in addition to counteracting the protrusion of the lips. These indentations may have different dimensions and shapes, in particular with a view to obtaining finger-apt openings. Also in this case, it is advantageous if the indentations have no sharp edges, but have forms as round as possible. The depth of an indentation likewise may vary, yet should not exceed a certain depth so that reaching through the openings by a finger will not to be impeded.

A particularly advantageous pacifier is realized in that the two shield frame parts in one piece join a central circular shield part that includes the central opening for the nipple. The central upper and central lower lip regions are thereby held back surfacially so as to prevent the protrusion of the lips on those sites. Moreover, this ensures a stable configuration of the pacifier shield as a whole and, in particular, in the region of the nipple fastening, where also a grip cap covering the nipple fastening site may be attached on the side opposite the nipple, as is common practice. In addition, this renders feasible a particularly simple form of the shield, which may also be advantageous in respect to manufacturing processes. Furthermore, the shield frame parts—which, in the instance case, are strap-shaped—may be sufficiently firmly connected with the circular shield part. The central circular shield part allows for the safe clamping of the nipple on the shield within the central opening, where the size of the circular shield part may vary as a function of the size of the shield frame parts or the size of the nipple.

Particularly preferred is a pacifier in which the two frame parts have approximately U-shaped or C-shaped cross sectional profiles. Such profiles enhance the stiffness of the frame parts of the shield so as to practically avoid twisting, bending or buckling of said frame parts even if they are designed to be narrow. Basically, any other reinforcing profile is conceivable, yet the C shape or arcuate shape offers the advantage of automatically yielding rounded shapes, i.e., avoiding sharp edges.

Preferably, the round side or web side of the C-shaped cross sectional profile is oriented in the direction of the nipple. When using the pacifier, the round side of the frame parts will, thus, abut on the skin of the mouth region of the infant. This is more comfortable for the infant, because the shield frame parts will not cut into the skin in the mouth region of the infant even during intensive sucking.

An advantageous embodiment is offered in that the lateral openings, in the sense of the longitudinal axis, have a length of about 10 mm to 30 mm, preferably about 15 mm to 20 mm, and, transverse thereto, have a width of about 15 mm to 35 mm, preferably about 20 mm to 30 mm. These dimensions ensure the formation of a shield that complies with the stipulations regulating pacifier shield openings. The length or the width of the lateral openings may vary within these dimensions, wherein particularly large lateral openings are suitable, in particular, for infants who are prone to inflammations in the mouth region. On the other hand, the dimensions also may be adapted to the age of an infant, particularly large lateral openings being suitable for younger children using the pacifier over extended periods of time and causing more saliva to emerge from the mouth.

In the course of safety investigations it has been found that a child's finger will no longer get stuck in the event of round openings having diameters of 12 mm and, from a diameter of 14 mm, an adult may readily dip into the openings by a finger in order to hold the pacifier: it is, therefore, advantageous if the lateral openings have a clear width of at least 14 mm over their entire peripheries. In other words, this means that each of the two lateral openings has such a dimension and shape that a pin having a circular cross section and a diameter of 14 mm may be pushed through the opening.

Preferably, the nipple comprises an end bead and is fastened to the shield within the central opening by means of a wedge-shaped plug inserted in said opening. The end bead prevents the nipple from slipping through between the edge of the opening and the plug such that the nipple is firmly fixed in the shield, thereby eliminating the risk of the nipple being loosened and hence swallowed by the infant. Suitably, the plug is held in its clamped position by a grip cap. Another advantage resides in that this way of clamping the nipple on the shield merely requires little space, wherefor the central circular shield part can be kept small.

A particularly advantageous embodiment is provided in that the plug and the end bead of the nipple are covered by a cap fastened to the shield. Thereby, the nipple fastening is covered and secured, on the one hand, so as to prevent any undesired loosening of the nipple. On the other hand, the cap may be designed to be readily seizable, thus serving as an (additional) grip.

According to a further aspect, the present invention provides a pacifier shield for a pacifier as described above.

BRIEF DESCRIPTION OF THE DRAWING

In the following, the invention will be explained in even more detail by way of a preferred exemplary embodiment illustrated in the drawing. Therein.

DETAILED DESCRIPTION OF THE PREFERRED EMBODIMENT

Figure 4:
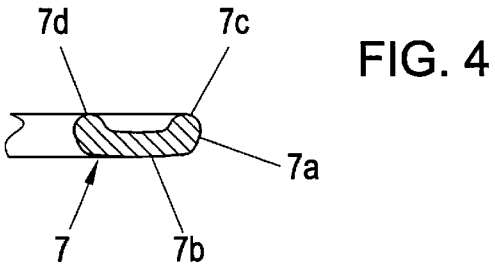
FIG. 4 represents a cross sectional view through a shield frame part according to line IV—IV of FIG. 1.
Figure 3:
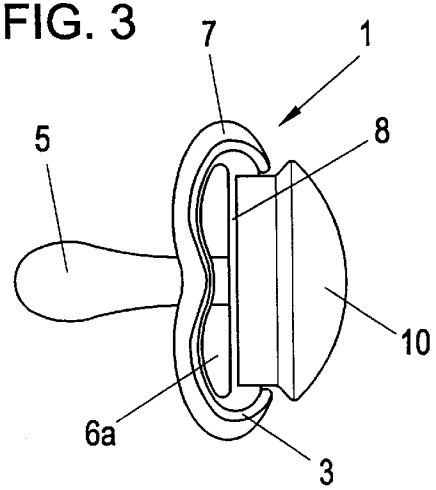
FIG. 3 is a side view of this pacifier in the sense of arrow A of FIG. 2.
Figure 2:
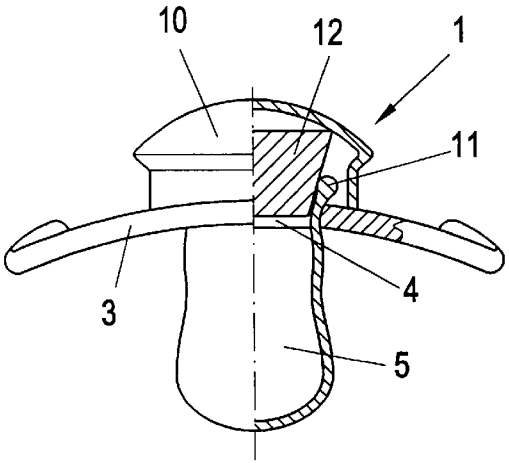
FIG. 2 is a partially exploded side view of this pacifier.
Figure 1:
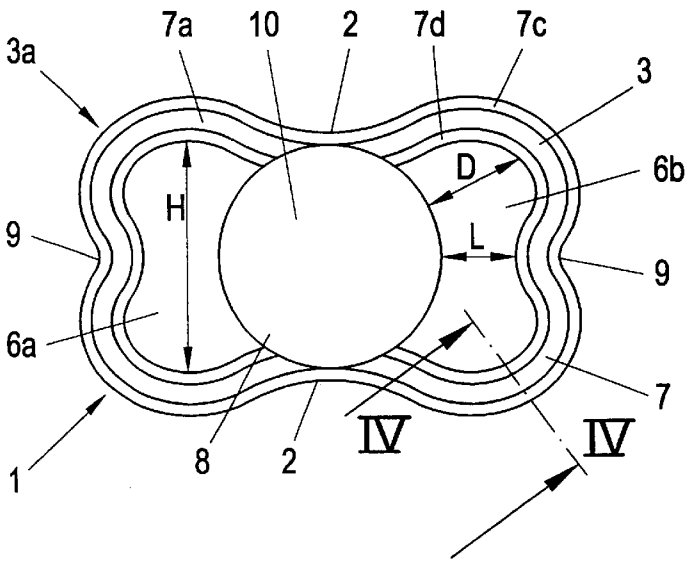
FIG. 1 is a view from below of a pacifier according to the invention.

In the drawing, FIGS. 1 to 3 depict a pacifier 1 including an approximately lemniscate-shaped shield 3 which is provided with central retractions 2 on its two longer sides and a central opening 4 for fastening a nipple 5 to the shield 3. Lateral openings 6*a,* 6*b* are provided on both sides of the central opening 4 in the shield 3, which lateral openings extend as far as to the shield edge and there are delimited by strap-shaped shield frame parts 7 that join a central circular shield part 8 in one piece. In the region of the longitudinal axis (which, according to the illustration in FIG. 1, is horizontal) indentations 9 are provided on the two shorter sides of the shield 3. The shield frame parts 7 have C-shaped cross sectional profiles 7*a,* as is apparent from FIG. 4. The round web side 7*b* of the profile faces the nipple 5, whereas the two flange or rib ledges 7*c,* 7*d* are provided on the cap side.

FIG. 2 is a partially cut-open side view of the pacifier 1, wherein the wedge-shaped plug 12 and the end bead 11 of the nipple 5 are covered by a cap 10 fastened to the shield 3, for instance, by ultrasonic welding. The cap 10 prevents the plug 12 from moving back from the shield opening 4 such that the nipple 5 is securely held within the shield 3.

The lateral openings 6*a,* 6*b* are dimensioned such that a pin having a circular cross section and a diameter D of 14 mm may be passed therethrough in accordance with the representation of FIG. 1, i.e., in one of the four "corner" regions each, for instance 3*a,* of the shield 3, between the central shield part 8, the shield frame part 7 and its respective indentation 9.

In general, the lateral openings 6*a,* 6*b* in the sense of the longitudinal axis, for instance, have dimensions L ranging from 10 mm to 30 mm, preferably 15 mm to 20 mm, and transverse thereto, have widths or heights H from about 15 mm to 35 mm, preferably 20 mm to 30 mm.

What I claim is:

1. In a pacifier arrangement of the type including a generally lemniscate-shaped shield having two longer shield sides and two shorter shield sides and a central shield opening, retractions provided on said two longer shield sides in a middle thereof, and a nipple fastened in said central opening of said shield, the improvement wherein said shield comprises but one lateral opening each provided on one side of said central shield opening and reaching as far as to an edge of said shield while leaving a first shield frame part on one side of said central opening and a second shield frame part on the other side of said central opening.

2. A pacifier arrangement as set forth in claim 1, wherein said first and second shield frame parts on said two shorter shield sides each comprise an indentation.

3. A pacifier arrangement as set forth in claim 2, wherein said indentation is located in the middle of each respective shorter shield side.

4. A pacifier arrangement as set forth in claim 1, further comprising a central circular shield part including said central shield opening for said nipple, and wherein said first and second shield frame parts join said central circular shield part in one piece.

5. A pacifier arrangement as set forth in claim 1, wherein each of said first and second shield frame parts has an approximately U-shaped cross sectional profile.

6. A pacifier arrangement as set forth in claim 1, wherein each of said first and second shield frame parts has an approximately C-shaped cross sectional profile.

7. A pacifier arrangement as set forth in claim 6, wherein said C-shaped cross sectional profile has a rounded web side oriented in the direction of the nipple.

8. A pacifier arrangement as set forth in claim 1, wherein said lateral opening, in a direction parallel to said longer shield sides, has a length of about 10 mm to 30 mm and, transverse thereto, has a width of about 15 mm to 35 mm.

9. A pacifier arrangement as set forth in claim 1, wherein said lateral opening, in a direction parallel to said longer shield sides, has a length of about 15 mm to 20 mm and, transverse thereto, has a width of about 20 mm to 30 mm.

10. A pacifier arrangement as set forth in claim 1, wherein said lateral opening has a clear width of at least 14 mm over its entire periphery.

11. A pacifier arrangement as set forth in claim 1, further comprising an end bead provided on said nipple and a wedge-shaped plug inserted in said central shield opening to fasten said nipple to said shield in said central shield opening.

12. A pacifier arrangement as set forth in claim 11, further comprising a cap fastened to said shield to cover said plug and said end bead of said nipple.

13. A pacifier shield to be used in the pacifier arrangement set forth in claim 1, 2, 3, 4, 5, 6, 7, 8, 9, 10, 11 or 12.

* * * * *

UNITED STATES PATENT AND TRADEMARK OFFICE

CERTIFICATE OF CORRECTION

PATENT NO. : 6,514,275 B2
APPLICATION NO. : 09/725782
DATED : February 4, 2003
INVENTOR(S) : Peter Roehrig It is certified that error appears in the above-identified patent and that said Letters Patent is hereby corrected as shown below:

On the cover page item [75] Inventor, line 1, "Peter Röhrig, Vienna (AT)" should be --Peter Röhrig, Vienna (AT); Ernst W. Beranek, Vienna (AT)--.

Signed and Sealed this

Eighth Day of July, 2008

JON W. DUDAS
*Director of the United States Patent and Trademark Office*